US006653264B1

(12) United States Patent
Sundman et al.

(10) Patent No.: US 6,653,264 B1
(45) Date of Patent: Nov. 25, 2003

(54) METHOD OF TREATING SURFACE OF FIBREBOARD WITH HYDROGEN PEROXIDE

(75) Inventors: Carl-Erik Sundman, Nacka (SE); Pia Hellström, Hjärtum (SE); Pär Nilsson, Göteborg (SE)

(73) Assignee: Akzo Nobel N.V., Arnhem (NL)

( * ) Notice: Subject to any disclaimer, the term of this patent is extended or adjusted under 35 U.S.C. 154(b) by 140 days.

(21) Appl. No.: 10/018,258

(22) PCT Filed: May 30, 2000

(86) PCT No.: PCT/SE00/01119

§ 371 (c)(1),
(2), (4) Date: Dec. 18, 2001

(87) PCT Pub. No.: WO00/78516

PCT Pub. Date: Dec. 28, 2000

Related U.S. Application Data

(60) Provisional application No. 60/139,723, filed on Jun. 18, 1999.

(30) Foreign Application Priority Data

Jun. 18, 1999 (EP) ..... 99850109

(51) Int. Cl.[7] ..... B27K 5/02; C11D 9/44; C11D 3/00

(52) U.S. Cl. ..... 510/109; 510/372; 510/466; 510/508; 510/511; 8/111

(58) Field of Search ..... 510/109, 372, 510/466, 508, 511; 8/111

(56) References Cited

U.S. PATENT DOCUMENTS

| | | | | | |
|---|---|---|---|---|---|
| 3,645,666 | A | * | 2/1972 | Bailey et al. | 8/111 |
| 4,735,851 | A | * | 4/1988 | Dodson et al. | 428/326 |
| 5,242,464 | A | * | 9/1993 | Armstrong et al. | 8/402 |
| 6,306,241 | B1 | * | 10/2001 | Chiu | 156/296 |
| 6,346,165 | B1 | * | 2/2002 | Markessini et al. | 156/296 |
| 6,355,461 | B2 | * | 3/2002 | Henriksen et al. | 435/189 |

FOREIGN PATENT DOCUMENTS

JP 57-38102 3/1982

OTHER PUBLICATIONS

Derwent Publications, XP–002122213, English language abstract of JP 62148208, Jul. 2, 1987.

* cited by examiner

*Primary Examiner*—Yogendra N. Gupta
*Assistant Examiner*—John M Petruncio
(74) *Attorney, Agent, or Firm*—David J. Serbin

(57) ABSTRACT

The invention relates to a method for surface treatment of board based on biological fibrous material comprising a step of contacting the surface of said board based on biological fibrous material with an aqueous solution containing hydrogen peroxide. The invention further concerns a composition suitable such treatment.

17 Claims, No Drawings

METHOD OF TREATING SURFACE OF FIBREBOARD WITH HYDROGEN PEROXIDE

This application claims the benefit of provisional application Ser. No. 60/139,723 filed Jun. 18, 1999.

The present invention relates to a method for surface treatment of board based on biological fibrous material with an aqueous solution containing hydrogen peroxide, and to an aqueous solution particularly suitable for performing the method.

Board based on biological fibrous material is commonly used in the building industry because it has good mechanical properties, is easy to machine and work with, and can be prepared from renewable raw materials. However, for some applications the market demands bright colours, which in many cases is hard to obtain, depending on the raw materials used. Particularly, the board often has a brownish or yellowish colour and looks dirty.

It is an object of the present invention to provide a method for treating board based on biological fibrous material to obtain a surface with attractive appearance, preferably with a bright, non brownish and yellowish colour, most preferably looking like recently sawn lumber. It is another object of the invention to provide an environmental friendly method for treating board based on biological fibrous material that is easy to perform, and that does not damage the board. It is still another object of the invention to provide a composition particularly suitable for performing the method.

It has now been found that these objects can be achieved by a method as defined in the appended claims. Thus, the invention concerns a method for surface treatment of board based on biological fibrous material comprising a step of contacting the surface of said board based on biological fibrous material with an aqueous solution containing hydrogen peroxide. The aqueous solution preferably contains from about 1 to about 50 wt % $H_2O_2$, most preferably from about 5 to about 35 wt % $H_2O_2$.

The biological fibrous material used for the board may, for example, be wood or different kinds of grass, such as bagasse or straws of wheat. The board is normally produced by pressing fibres, strands, particles, wafers, sheets, or the like, of the biological fibrous material together with a binding agent. Various kinds binding agents can be used, for example duroplastic resin systems such as urea-formaldehyde, melamine-urea-formaldehyde, phenol-formaldehyde or isocyanate. It is also possible to use or thermoplastic binding agent, such as polyvinyl acrylate, polyvinyl acetate, polyethylene or polyvinyl chloride.

The invention is particularly favourable for treating wood based board, which in this context refers to board prepared by pressing wooden fibres, strands, particles, wafers, sheets, or the like, together with a binding agent, such as those mentioned above. Most kinds of wood can be used, hardwood as well as softwood, preferably having a density from about 350 to about 1000 kg/m$^3$, such as spruce, pine, birch, aspen, red maple, rubber tree or marantii. Examples of commercially produced wood based boards that can be successfully treated according to the invention are particleboard, medium density fibre board (MDF), waferboard, oriented waferboard and oriented strand board (OSB). The method of the invention gives excellent result when OSB is treated. It is also possible to treat plywood with good results.

OSB is normally prepared from a resin and wooden strands, for example from about 10 to about 300 mm long and from about 2 to about 50 mm wide, lined up and arranged in about 3 to about 8 layers that are oriented at substantially right angles to one another. This gives a board with excellent mechanical properties, but unless its surface is treated according to the present invention, the visual appearance is still not satisfactory for many applications.

It has been found that better result and/or lower consumption of hydrogen peroxide is obtained if the aqueous solution for treating the board contains at least one surfactant, suitably in an amount from about 0.01 to about 20 wt %, preferably from about 0.1 to about 10 wt %, most preferably from about 0.1 to about 5 wt %. Particularly, it has been found that the presence of a surfactant in the aqueous solution decreases the risk for brownish or yellowish spots on the treated surface.

Preferred surfactants are compatible with hydrogen peroxide, which means that neither do they cause decomposition of the hydrogen peroxide, nor does the hydrogen peroxide cause decomposition of the surfactants. Further, the surfactant is preferably environmental friendly and biodegradable. Non-ionic surfactants are particularly preferred, but also amphoteric and/or an-ionic surfactants can be used.

Preferred non-ionic surfactants are selected from ethoxylated and/or propoxylated fatty acids, alcohols, phenols, amines or amides, preferably comprising from 1 to 15 most preferably from 4 to 8 moles ethylene oxide and from 0 to 5, preferably from 0 to 3 mols propylene oxide per mole acid, alcohol, phenol, amine or amide. Preferably the acid, alcohol, phenol, amine or amide comprises from 7 to 18, most preferably from 9 to 12 carbon atoms. Ethoxylated and optionally propoxylated alcohols are particularly preferred. Such surfactants are commercially available from Akzo Nobel under the trademarks Berol®048, Berol®185, Berol®266 and Berol®537.

It has also been found that both the visual appearance and the long term stability in UV light of the treated board, can be further improved if the aqueous solution contains a dispersion of at least one of solid silica or a solid metal oxide, such as an oxide of at least one of titanium, aluminium, antimony, tin, zirconium or cerium. The solution preferably contains from about 0.005 to about 10 wt % dispersed solid silica or metal oxide, most preferably from about 0.1 to about 5 wt % dispersed solid silica or metal oxide. However, unless used in combination with hydrogen peroxide, the silica or metal oxide does not give any effect.

The dispersion of silica or metal oxide is preferably in the form of a colloidal solution of dense, non-agglomerated particles, normally having a mean particle diameter from about 2 to about 500 nm, which corresponds to a specific surface from about 5 to about 1300 m$^2$/gram. In order to obtain optimal stability of the treated board in UV light, the mean particle diameter of the silica or metal oxide is preferably from about 5 to about 400 nm, most preferably from about 10 to about 300 nm, which corresponds to a specific surface from about 500 to about 7 m$^2$/gram, preferably from about 270 to about 10 m$^2$/gram.

Colloidal silica is particularly useful as silica does not catalyse decomposition of hydrogen peroxide. Further, colloidal silica is commercially available in the form of stable aqueous silica sols that easily can be mixed with hydrogen peroxide solutions. Preferred aqueous silica sols are compatible with hydrogen peroxide, which means that neither do they cause decomposition of the hydrogen peroxide, nor does the hydrogen peroxide cause gelling of the silica. In one embodiment, an acidic silica sol is used, suitably having a pH, before addition to the hydrogen peroxide, from about 1 to about 7, preferably from about 2 to about 5. Particularly preferred acidic silica sols are cationic and contains silica particles that are surface modified with oxides or hydroxides of preferably polyvalent metals or other elements, such as at least one of aluminium, boron, titanium, antimony, tin, zirconium or cerium. Examples of silica sols of this kind commercially available from Eka Chemicals are Bindzil®CAT, Bindzil®CAT 80, Bindzil®CAT 220 and Bindzil®CAT 500. Other useful acidic silica sols are de-ionised sols, such Nyacol®2034 DI (Eka Chemicals).

In another embodiment, an alkaline silica sols is used, suitably with a pH, before addition to the hydrogen peroxide, from about 8 to about 11, preferably from about 8.5 to about 10.5. If an alkaline silica sol is used, it is preferably added in an amount so the pH of the resulting aqueous solution is not lower than about 3, most preferably not lower than about 4. Preferred alkaline silica sols are mainly stabilized with ammonium, such as Bindzil®15 $NH_3$ 500 (Eka Chemicals), which minimises the deposition of salts on the treated surface of the board.

When contacting the surface of the board, the pH of the aqueous solution is preferably from about 2 to about 11, most preferably from about 2 to about 9. It has been found that the treated board becomes yellowish if the pH is too low, while too high a pH decreases the stability of the hydrogen peroxide. Since the pH depends on the components of the solution, it may be appropriate to adjust the pH by adding to the solution small amounts of, for example, alkali metal hydroxide, sulfuric acid or other agents commonly used for that purpose. If treatment at high pH is desirable, it may be appropriate to separately add alkali metal hydroxide or any other pH adjusting component to the surface of the board.

It is also possible to include further additives in the aqueous solution, such as hydrophobizing agents, preferably in an amount from about 0.1 to about 10 wt %, most preferably from about 0.1 to about 5 wt %. Examples of useful hydrophobizing agents are non-ionic surfactants such as nonyl phenol ethoxylate, non-ionic paraffin wax dispersions, and short oil alkyd resin emulsions. It is also possible to use micro emulsions of any hydrophobic substance.

The temperature of the aqueous solution when contacting the surface of the board is preferably from about 10 to about 160° C., most preferably from about 15 to about 100° C. It has been found that too high a temperature result in a yellowish surface of the treated board. If a newly prepared piece of board has a temperature above about 100° C., it is preferable to let it cool down before the treatment.

The surface of the board can be contacted with the aqueous solution by all methods commonly used for surface treatment, for example by flushing or spraying the solution thereon, which is most preferred, or by curtain coating or by different kinds of rolls. After the treatment, the board may be left to dry, for example in piles of several pieces of board being in close contact to each other. Preferably from about 10 about 5000 ml solution per $m^2$ board, most preferably from about 100 about 1000 ml solution per $m^2$ board is used.

It is possible to achieve good results with a very low consumption of hydrogen peroxide, for example from about 5 to about 150 g $H_2O_2$ per $m^2$ board, preferably from about 10 to about 50 g $H_2O_2$ per $m^2$ board.

The invention also concerns a novel aqueous solution particularly suitable for treating the surface of board based on biological fibrous material. Such an aqueous solution contains from about 1 to about 50 wt %, preferably from about 5 to about 35 wt % of hydrogen peroxide, and a dispersion of from about 0.005 to about 10 wt % of at least one of solid silica or a solid metal oxide, most preferably from about 0.1 to about 5 wt % of at least one of solid silica or a solid metal oxide. The solution further preferably contains at least one surfactant, suitably in an amount from about 0.01 to about 20 wt %, preferably from about 0.1 to about 10 wt %, most preferably from about 0.1 to about 5 wt %. In order to obtain good storage stability of the solution, the pH is preferably from about 2 to about 10, most preferably from about 2 to about 8. Further details regarding optional and preferred embodiments of the solution are described above in connection with the method of the invention.

The invention is further illustrated in the following example, which, however, is not intended to limit the scope of the invention.

EXAMPLE

Samples of commercially available OSB board were treated at a temperature of about 25° C. by painting on each sample 250 ml/$m^2$ of an aqueous hydrogen peroxide solution having different compositions. The samples were left to dry for 24 hours at about 25° C., and were then examined visually and marked with a grade from 1–3 (wherein 3 refers to the best result). For most of the samples also the brightness was measured before and after the treatment with a BYK Gardners Color guide with the following adjustments:

slit width: 11 mm color equation: CIELab settings: D-65 light. 10° observer.

The displayed result is an average of 9 measurements at different locations of the board sample.

The surfactant used was added to the hydrogen peroxide solution as a 90 wt % aqueous solution of ethoxylated and propoxylated $C_{10}$–$C_{14}$ fatty alcohols with 7 moles ethylene oxide and 1 mole propylene oxide. The silica was added to the hydrogen peroxide solution as aqueous silica sols. Four different sols were used: Bindzil®CAT 500, an acidic 15 wt % colloidal dispersion of cationic silica particles surface modified with $Al_2O_3$ and having a specific surface area of 500 $m^2$/gram; Bindzil®15/$NH_3$ 500, an alkaline ammonium containing 15 wt % colloidal dispersion of anionic silica particles having a specific surface area of 500 $m^2$/gram; Bindzil®CAT 80, an acidic 43 wt % colloidal dispersion of cationic silica particles surface modified with $Al_2O_3$ and having a specific surface area of 80 $m^2$/gram; Nyacol®2034 DI, a de-ionised acidic 40 wt % colloidal dispersion of anionic silica particles having an average particles diameter of 20 nm. The pH was measured directly on the surface of the board during the treatment.

The results are shown in Table 1 below:

TABLE 1

| $H_2O_2$ wt % | Surfactant wt % | CAT 500 wt % $SiO_2$ | CAT 500 NH3 wt % $SiO_2$ | CAT 80 wt % $SiO_2$ | Nyacol wt % $SiO_2$ | pH | Brightness before treatment (%) | Brightness after treatment (%) | Visual exam. Grade | Comment |
|---|---|---|---|---|---|---|---|---|---|---|
| — | — | — | — | — | — | 5.1 | 73.8 | 73.9 | 1 | |
| — | 1 | — | — | — | — | 5.2 | 72.6 | 73.1 | 1 | |
| — | — | — | — | 0.4 | — | 5.0 | 70.9 | 73.0 | 1 | |

TABLE 1-continued

| $H_2O_2$ wt % | Surfactant wt % | CAT 500 wt % $SiO_2$ | CAT 500 NH3 wt % $SiO_2$ | CAT 80 wt % $SiO_2$ | Nyacol wt % $SiO_2$ | pH | Brightness before treatment (%) | Brightness after treatment (%) | Visual exam. Grade | Comment |
|---|---|---|---|---|---|---|---|---|---|---|
| — | — | 0.4 | — | — | — | 4.9 | 72.0 | 74.5 | 1 | |
| — | — | — | — | — | 0.4 | 5.1 | 73.7 | 73.6 | 1 | |
| 18 | — | — | — | — | — | 4.8 | 69.4 | 74.5 | 2 | difficult to apply |
| 18 | 1 | — | — | — | — | 4.2[1] | 71.6 | 77.0 | 3– | |
| 18 | 1 | — | — | — | — | 8.0[2] | 70.6 | 80.6 | 3+ | $H_2O_2$ un-stable |
| 18 | 1 | — | — | — | — | 4.5 | 71.0 | 77.4 | 3 | |
| 18 | 1 | — | — | 0.4 | — | 5.1 | 70.0 | 78.6 | 3+ | |
| 18 | 1 | 0.4 | — | — | — | 4.1 | 71.9 | 77.7 | 3+ | |
| 18 | 1 | — | — | — | 0.4 | 4.8 | 71.7 | 78.4 | 3+ | |
| 18 | 1 | — | 0.3 | — | — | 5.5 | 71.6 | 79.8 | 3+ | |
| 18 | 1 | 0.3 | — | — | — | 4.0 | 72.0 | 80.2 | 3+ | |
| 18 | 1 | — | — | 0.86 | — | 4.2 | 71.2 | 80.2 | 3+ | |
| 18 | 1 | — | — | — | 0.8 | 5.2 | 69.8 | 78.9 | 3+ | |
| 18 | 1 | — | 1.5 | — | — | 7.5 | 71.0 | 82.4 | 3+ | $SiO_2$ gels after 24 hrs |
| 9 | 1 | — | — | — | — | 4.9 | —[3] | —[3] | 3 | |
| 4.5 | 1 | — | — | — | — | 4.5 | —[3] | —[3] | 3 | |
| 2.3 | 1 | — | — | — | — | 5.6 | —[3] | —[3] | 2 | |

[1]= sulfuric acid added
[2]= sodium hydroxide added
[3]= brightness is not measured

What is claimed is:

1. Method for treating a surface of board produced by pressing fibers, strands, particles, wafers, or sheets of biological fibrous material together with a binding agent, comprising a step of contacting the surface of said board with an aqueous solution containing hydrogen peroxide.

2. Method as claimed in claim 1, wherein the aqueous solution contains from about 1 to about 50 wt % of hydrogen peroxide.

3. Method as claimed in claim 1, wherein the aqueous solution further contains at least one surfactant.

4. Method as claimed in claim 3, wherein the at least one surfactant is selected from non-ionic surfactants.

5. Method as claimed in claim 1, wherein the aqueous solution contains a dispersion of at least one of solid silica or a solid metal oxide.

6. Method as claimed in claim 5, wherein the aqueous solution contains from about 0.005 to about 10 wt % dispersed solid silica or metal oxide.

7. Method as claimed in claim 4, wherein the mean particle diameter of the solid silica or metal oxide is from about 5 to about 400 nm.

8. Method as claimed in claim 4, wherein the dispersion of at least one of solid silica or a solid metal oxide is an aqueous silica sol.

9. Method as claimed in claim 1, wherein the temperature of the aqueous solution when contacting the surface of the board is from about 15 to about 100° C.

10. Method as claimed in claim 1, wherein the biological fibrous material is wood based.

11. Method as claimed in claim 10, wherein the board is an oriented strand board (OSB).

12. Method for treating a surface of wood based board selected from the group consisting of particleboard, medium density fiber board (MDF), waferboard, oriented wafer board and oriented strand board (OSB), comprising a step of contacting the surface of said board with an aqueous solution containing from about 1 to about 50 wt % of hydrogen peroxide.

13. Method for treating a surface of board produced by pressing fibers, strands, particles, or wafers of biological fibrous material together with a binding agent, comprising a step of contacting the surface of said board with an aqueous solution containing hydrogen peroxide and at least one surfactant.

14. Aqueous solution suitable for treating the surface of board based on biological fibrous material comprising from about 1 to about 50 wt % of hydrogen peroxide, and a dispersion of from about 0.005 to about 10 wt % of at least one of solid silica or a solid metal oxide.

15. Aqueous solution as claimed in claim 14, wherein the aqueous solution contains from about 0.01 to about 20 wt % of a surfactant.

16. Aqueous solution as claimed in claim 14, wherein the dispersion of at least one of solid silica or a solid metal oxide is an aqueous silica sol.

17. Aqueous solution as claimed in claim 14, wherein the pH of the aqueous solution is from about 2 to about 10.

* * * * *